US008556296B2

(12) United States Patent
Allen

(10) Patent No.: US 8,556,296 B2
(45) Date of Patent: Oct. 15, 2013

(54) MINIATURE SKI TOTE

(76) Inventor: Kyle M. Allen, Lafayette, LA (US)

( * ) Notice: Subject to any disclaimer, the term of this patent is extended or adjusted under 35 U.S.C. 154(b) by 0 days.

(21) Appl. No.: 13/146,792

(22) PCT Filed: Jun. 30, 2009

(86) PCT No.: PCT/US2009/049204

§ 371 (c)(1),
(2), (4) Date: Jul. 28, 2011

(87) PCT Pub. No.: WO2010/093378

PCT Pub. Date: Aug. 19, 2010

(65) Prior Publication Data

US 2011/0285121 A1 Nov. 24, 2011

Related U.S. Application Data

(60) Provisional application No. 61/152,231, filed on Feb. 12, 2009.

(51) Int. Cl.
*A63C 11/00* (2006.01)

(52) U.S. Cl.
USPC ..... 280/814; 280/809; 280/815; 280/47.131

(58) Field of Classification Search
USPC ..... 280/809, 814, 815, 816, 47.131, 47.32, 280/78, 79.11, 79.7
See application file for complete search history.

(56) References Cited

U.S. PATENT DOCUMENTS 2,128,036 A * 8/1938 Butler, Jr. ..... 280/815
3,731,348 A * 5/1973 Luehne ..... 280/814
3,909,718 A * 9/1975 Allsop et al. ..... 294/162
4,540,198 A * 9/1985 Kyburz ..... 280/814
4,666,184 A * 5/1987 Garvey, Jr. ..... 280/814
4,705,281 A * 11/1987 Spinas ..... 280/47.131
4,772,047 A * 9/1988 Leaf ..... 280/815
4,830,403 A * 5/1989 Ohmori ..... 280/815
4,867,307 A * 9/1989 Bovee ..... 206/315.1
4,968,060 A * 11/1990 Rooney ..... 280/814

(Continued)

FOREIGN PATENT DOCUMENTS

CH 581487 A5 * 11/1976
WO WO 2009007959 A1 * 1/2009

OTHER PUBLICATIONS

Raw machine translation of description of CH 581487.*

*Primary Examiner* — John R Olszewski
*Assistant Examiner* — Steve Clemmons
(74) *Attorney, Agent, or Firm* — Lemoine & Associates LLC

(57) ABSTRACT

The miniature ski tote of the disclosed invention is characterized by a carriage body, wheel and strap or other means to removably bind the carriage body to a pair of skis disposed in bottom-to-bottom relationship. The carriage has a bottom, sides and a rear together forming a channel open to the front and top of the carriage body. The channel is configured to receive the front or rear portion of side edges of the of a pair of skis which are disposed in bottom-to-bottom relationship to one another. A strap or other binding means is used to removably bind the carriage body to the skis. A wheel projects rearwardly and downwardly of the carriage body when the front of carriage body is angled upwardly, enabling a pair of skis engaged therewith to be transported by rolling the end to which the carriage is attached.

10 Claims, 7 Drawing Sheets

(56) References Cited

U.S. PATENT DOCUMENTS

| | | | | | |
|---|---|---|---|---|---|
| 5,066,044 | A | * | 11/1991 | Adasek | 280/815 |
| 5,104,017 | A | * | 4/1992 | Vandagriff | 224/609 |
| 5,197,760 | A | * | 3/1993 | Schollenberger | 280/814 |
| 5,240,285 | A | * | 8/1993 | Harris | 280/814 |
| 5,310,221 | A | * | 5/1994 | Schmidt | 280/809 |
| 5,356,180 | A | * | 10/1994 | Adasek | 280/814 |
| 6,086,102 | A | * | 7/2000 | Stark et al. | 280/814 |
| 6,848,718 | B2 | * | 2/2005 | Ravikumar et al. | 280/814 |
| 7,621,563 | B1 | * | 11/2009 | Mitchell | 280/814 |
| 2007/0222168 | A1 | * | 9/2007 | Sellers et al. | 280/79.7 |

* cited by examiner

MINIATURE SKI TOTE

CROSS REFERENCE TO RELATED APPLICATIONS

This application claims priority to U.S. Provisional Patent Application No. 61/152,231 filed Feb. 12, 2009.

BACKGROUND OF THE INVENTION

1. Field of Invention

The invention relates generally to field of skiing, more particularly to apparatus used to facilitate the rolling transportation of skis to and/or from staging and storage areas, across parking lots, sidewalks, floors and the like from and/or to the place where the skis are to installed on the feet of skiers.

2. General Background

Snow skiing is a popular activity. Transportation of skis, along with ski boots and poles to and from places, such as to and/or from parking lots, sidewalks, floors, staging areas and the like, where the skis are to be installed on the feet is an inconvenience associated with skiing. Depending on the length, weight, configuration of a pair of skis, the distance they are to be transported, the surface over which they are to be transported and conditions existing at the time, the transportation of a pair of skis from staging and/or storage areas, to the point where the skis can actually be installed on the feet, can constitute a relatively arduous chore. Such chore is made more arduous if more than one pair of skis is to be transported, if bindings are installed on the skis at the time of transport (which is almost always the case), if ski boots and ski poles are also to be transported from a staging or storage area to a place where the skis are to be installed on the feet of the skier. A skier faces a similar when skiing ends and one or more pair of skis, along with bindings, boots, poles and the like are transported from the point where the skis are removed from the feet and transported back to staging or storage areas.

A number of devices have been invented to facilitate the task of transporting skis and associated skiing equipment to and from staging or storage areas to the place where the skis are to be installed on the. One such device is seen in U.S. Pat. No. 4,268,050 to Kennedy Sr. While such device has certain utility, it also has certain limitations. It is relatively complex, bulky and is therefore probably expensive to manufacture and sell. Moreover such device is large therefore will not fit in many lockers available at ski lodges and the like. Even if it would fit there is typically a fee for rental of such lockers. Typically the larger the locker the more the fee. Furthermore the skier may be returning to the same location he or she departed from. In such situation the skier is faced with question of what to do with the device left at the starting location and also facing the prospect of having no device to aid transportation of the skis at the destination location.

So far as applicant is aware there is no prior art which teaches a miniature ski transport which is simple, effective, inexpensive, easy to use and small, light enough to be carried on the skier when he or she is skiing or easily stored in even a small size locker.

OBJECTS OF THE INVENTION

A principal object of the invention herein disclosed and claimed is to provide an improved ski transport. More particularly an object of the invention is to provide an effective device to aid the transportation of skis to and from staging and storage areas to a point where the skis are to be installed on the feet of the skier. Additional objects of the invention are to provide a ski tote which is inexpensive and easy to use.

Another principal object of the invention is to provide a ski transport which is, in addition to being effective, inexpensive and easy to use, is also sufficiently small and light that in may carried on the skier while skiing or stored in an even small locker when not being used to transport skis.

SUMMARY OF THE INVENTION

The invention herein disclosed and claimed accomplishes the above stated objects by providing small, light carriage configured to be removably attached a small portion (front or rear) of the edges of a pair of skis disposed in bottom-to-bottom relationship. Means, such as strap or equivalent is provided to bind the skis to the small, light carriage during transport of the skis to and from staging or storage areas and may also be used to attached the ski tote of the invention to ring or loop of the skier's clothing while skiing. At least one wheel projects rearwardly from the carriage. As the opposite end of a pair of skis which are engaged with the carriage is lifted the wheel engages with the surface across which the skis are to be transported and, therefore, the carriage (with skis engaged therewith) may be rollingly transported across said surface. When transport of the skis is completed the carriage may be release from the skis and put in a pocket of the skier, attached to a ring or loop of fabric on the skier's clothing or stored in even a small sized locker.

The ski tote of the invention is simple and easy to use. It is easily attached or removed from pair of skis by releasing binding strap or equivalent means. It need not be removed from pair of skis when the skis are carried by hand, transported by vehicle or stored overnight or longer periods of time.

BRIEF DESCRIPTION OF THE DRAWINGS

For further understanding of the nature and objects of the present invention, reference should be made to following description of the preferred embodiment of the invention taken in conjunction with the accompanying drawings, in which like parts are given like reference numerals, and wherein.

DESCRIPTION OF THE PREFERRED EMBODIMENT OF THE INVENTION

Figure 1:
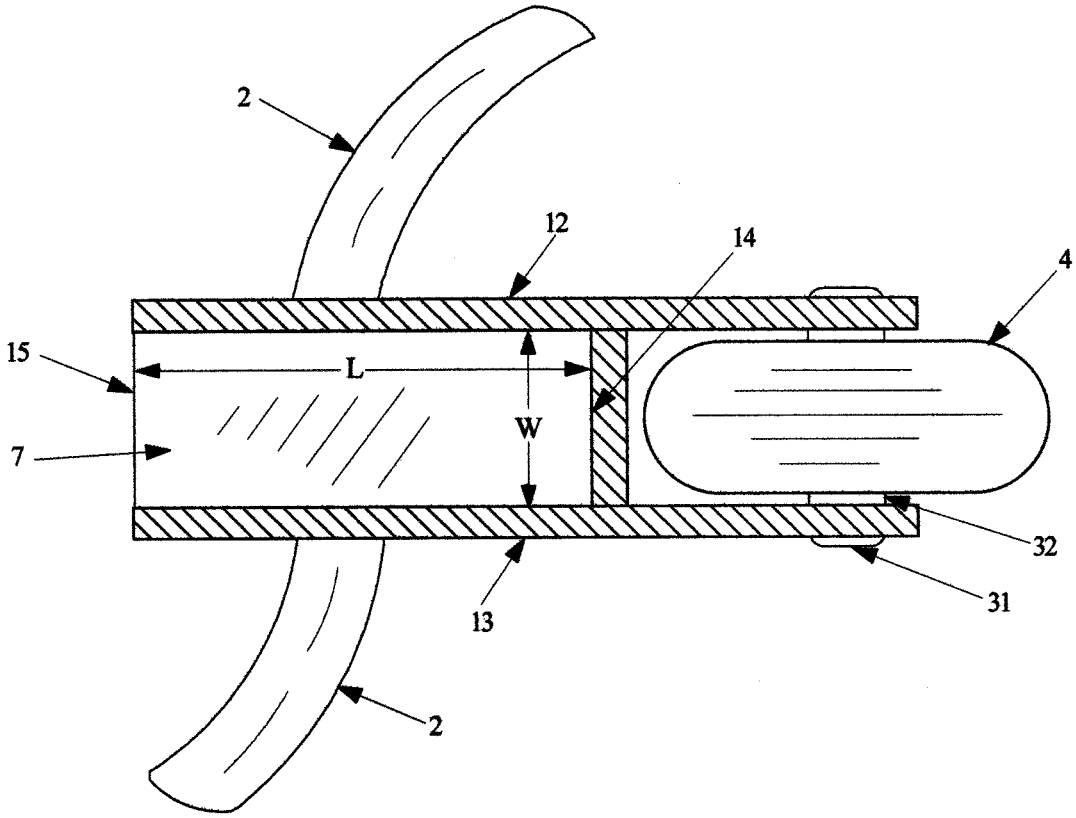
FIG. 1 is overhead view of the invention as configured to engage with the edge of the rear (non-curved) end of a pair of skis.
Figure 2:
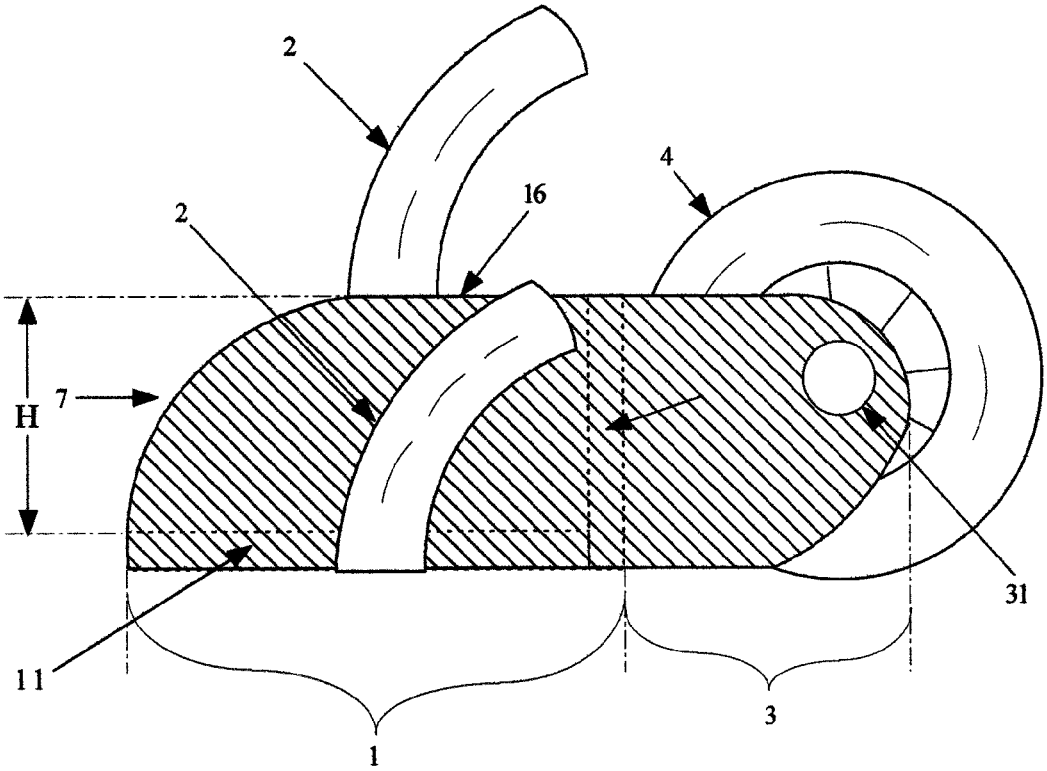
FIG. 2 is a side elevation of the invention as configured to engage with the edge of the rear (non-curved) end of a pair of skis.

While the present invention will be described with reference to preferred embodiments, it will be understood by those who are skilled in the art that various changes may be made and equivalents may be substituted for elements thereof without departing from the scope of the invention. In addition, many modifications may be made to adapt a particular situation or material to the teachings of the invention without departing from the essential scope thereof. It is therefore intended that the present invention not be limited to the particular embodiments disclosed as the best mode contemplated for carrying out this invention, but that the invention will include all embodiments and legal equivalents thereof.

The invention herein disclosed has two preferred embodiments. In both of said embodiments the principal components of the invention are a carriage body 1; binding means 2, wheel-mounting means 3 and wheel 4. In both embodiments of the invention there is a "U" shaped channel 7 in which the side edges of a pair of skis 5 disposed in bottom-to-bottom relationship to each other are to be placed.

In the first embodiment of the invention, illustrated in FIGS. 1, 2, 3 and 4, the "U" shaped channel 7 of the carriage body 1 is configured to receive the side edges of the rear (non-curved) end of a pair of skis disposed in bottom-to-bottom relationship to each other. In the second embodiment of the invention, illustrated in FIGS. 5, 6 and 7 the "U" shaped channel 7 of the carriage body 1 is configured to receive the side edges of the front (curved) end of a pair of skis disposed in bottom-to-bottom relationship to each other.

Figure 3:
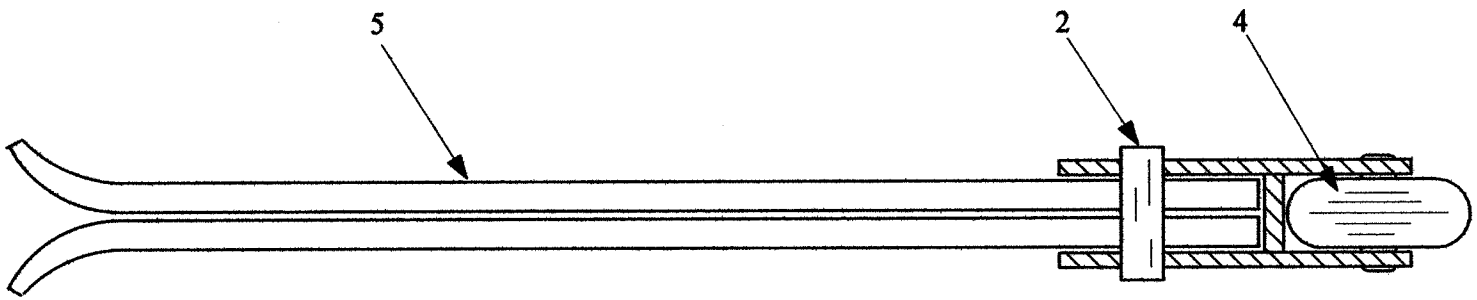
FIG. 3 is an overhead view showing the device of FIGS. 1 and 2 installed on the edge of the rear (non-curved) end of a pair of skis.
Figure 4:
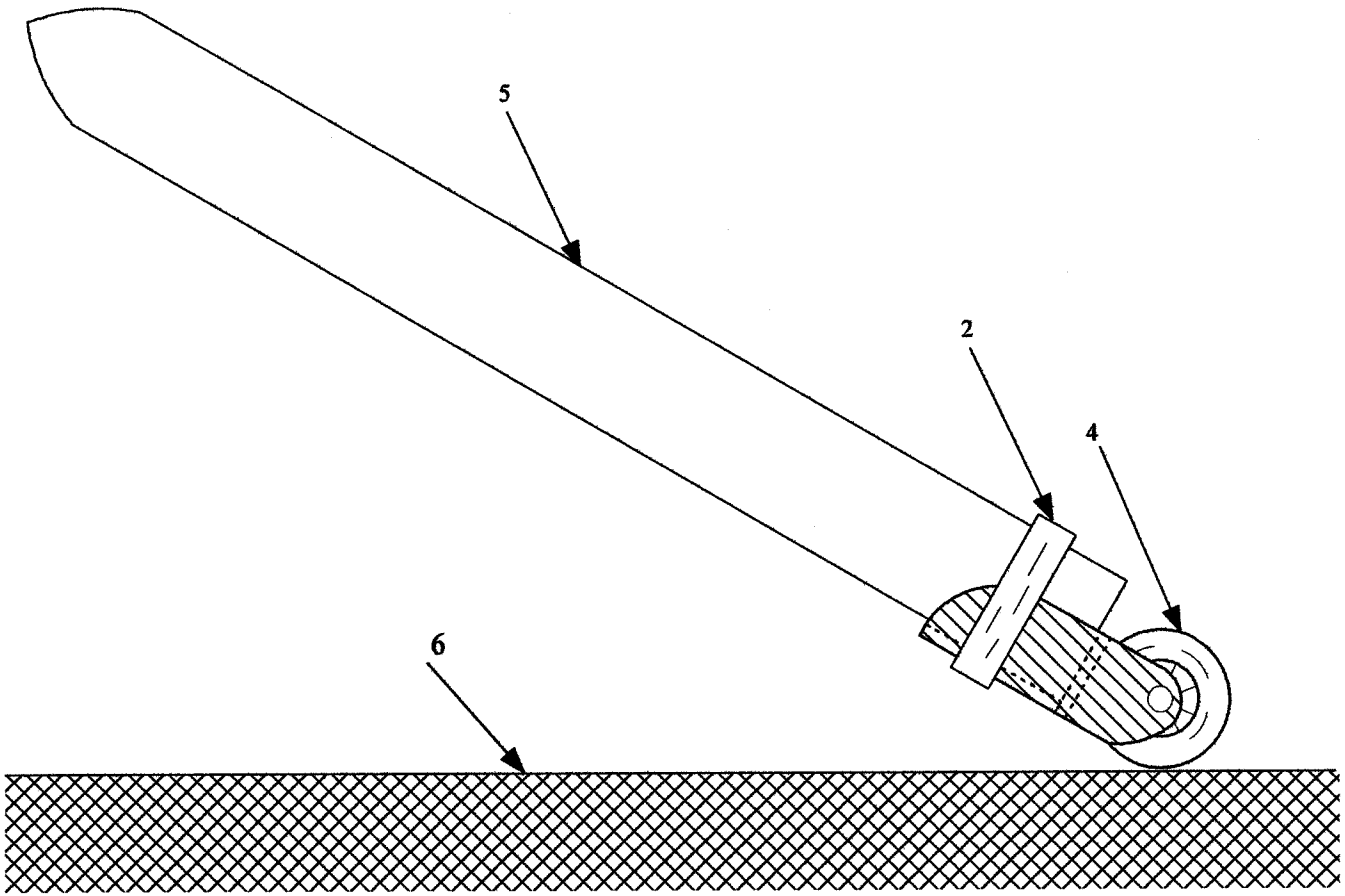
FIG. 4 is side elevation of view showing the device of FIG. 3 with front end of the skis lifted above the surface across which the skis are being transported.

FIGS. 1, 2, 3 and 4 illustrate the first embodiment of the invention (designed to engage the side edges of the rear, non-curved end of a pair of skis disposed in bottom-to-bottom relationship). Referring to said figures it is seen that this embodiment of the invention generally includes the following principal components: a carriage body 1; binding means 2, wheel-mounting means 3 and wheel 4. Shown in FIGS. 3 and 4 is the invention installed on pair of skis 5 (disposed in bottom-to-bottom relationship).

In the first embodiment of the invention carriage body 1 has a bottom 11, first side 12, second side 13 and rear 14 which together form a generally "U" shaped channel 7 which is open at the front 15 and top 16. In this embodiment of the invention channel 7 is sized, shaped and otherwise configured to receive a relatively small (as compared to the length of skis) portion, namely the portion proximate the "rear" or "back" of a ski, of the side edges of a pair of skis 5 disposed in bottom-to-bottom relationship to each other (as illustrated in FIGS. 3 and 4).

In the first embodiment of the invention the width, "W", of channel 7 will be sized to be only slightly larger than the thickness of a pair of skis when the skis are in bottom-to-bottom relationship. The height, "H", of channel 7 is not critical. So far as ability to carry skis within the "U" shaped channel 7 of carriage body 1, "H" could be as high as the width of the rear edges of the skis disposed in said channel or even higher. On the other hand, if the skis were bound very tightly to carriage body 1 then "H" could constitute merely a small "lip" which keeps the skis from sliding laterally off of bottom 11 of carriage body 1. In practice it has been found that more than small lip is desirable for "H", but on the other hand, with portability of the invention in mind (ability to carry it in the pocket or hang it from a ring or strap of clothing) it is undesirable to make "H" too large; a height of about 2 inches constitutes a good compromise, holding the skis in carriage body 1 even if transportation is over fairly rough surface, while at the same time maintaining over-all portability of the invention.

Length, "L", of the "U" shaped channel 7 of channel 7 is also not very critical. So far as ability to retain skis longer would probably be better, but would reduce portability of the invention. So far as portability of the invention shorter would be better, but in the extreme shortness would make it too easy for skis to slide out of "U" shaped channel 7 particularly when transport is over rough surface. Again, in preference a compromise of "L" being about 2½ inches seems to provide good ability to retain skis yet provide for good portability of the invention.

Figure 5:
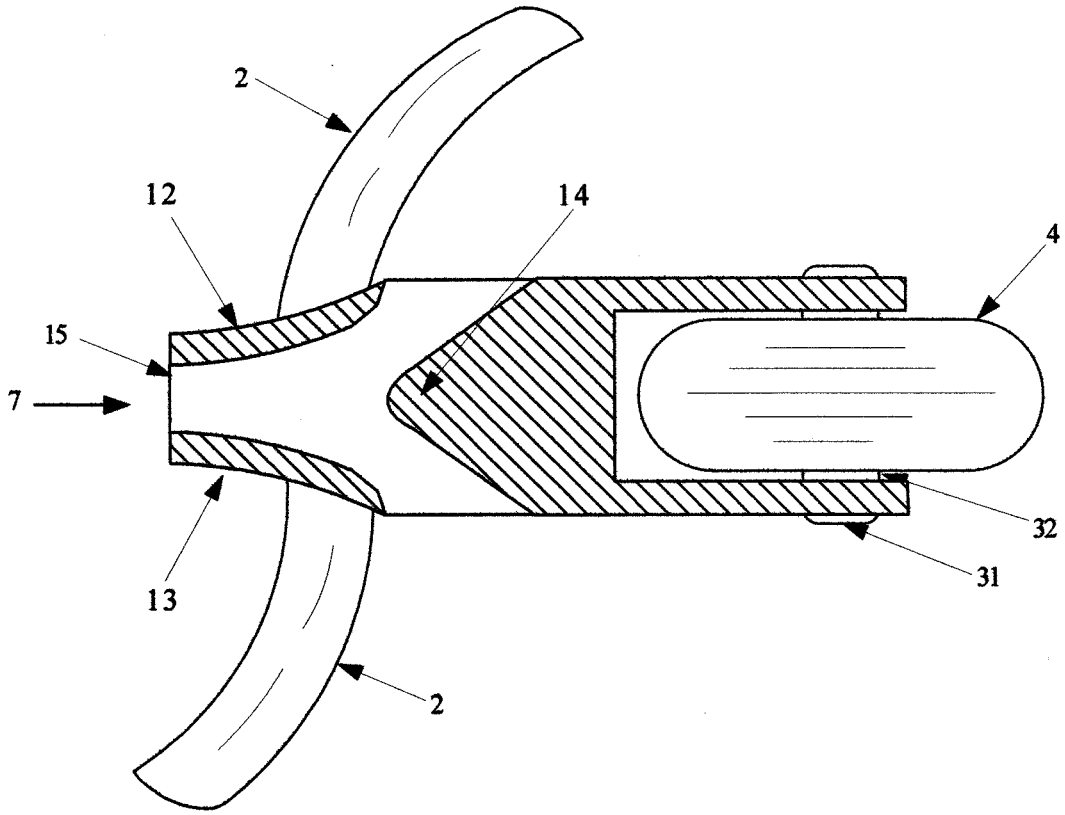
FIG. 5 is overhead view of the invention as configured to engage with the edge of the front (curved) end of a pair of skis.
Figure 6:
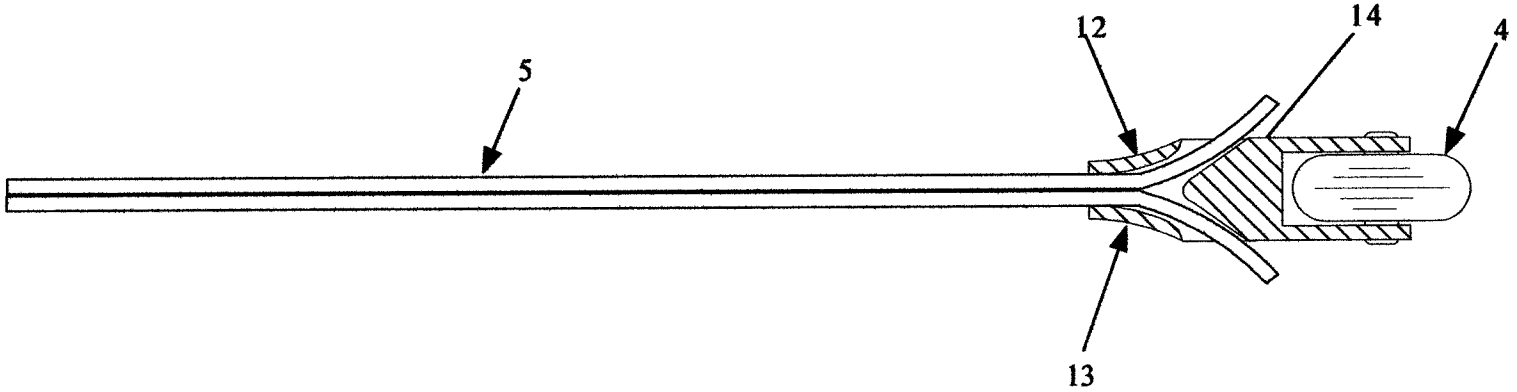
FIG. 6 is an overhead view showing the device of FIGS. 1 and 2 installed on the edge of the rear (curved) end of a pair of skis.
Figure 7:
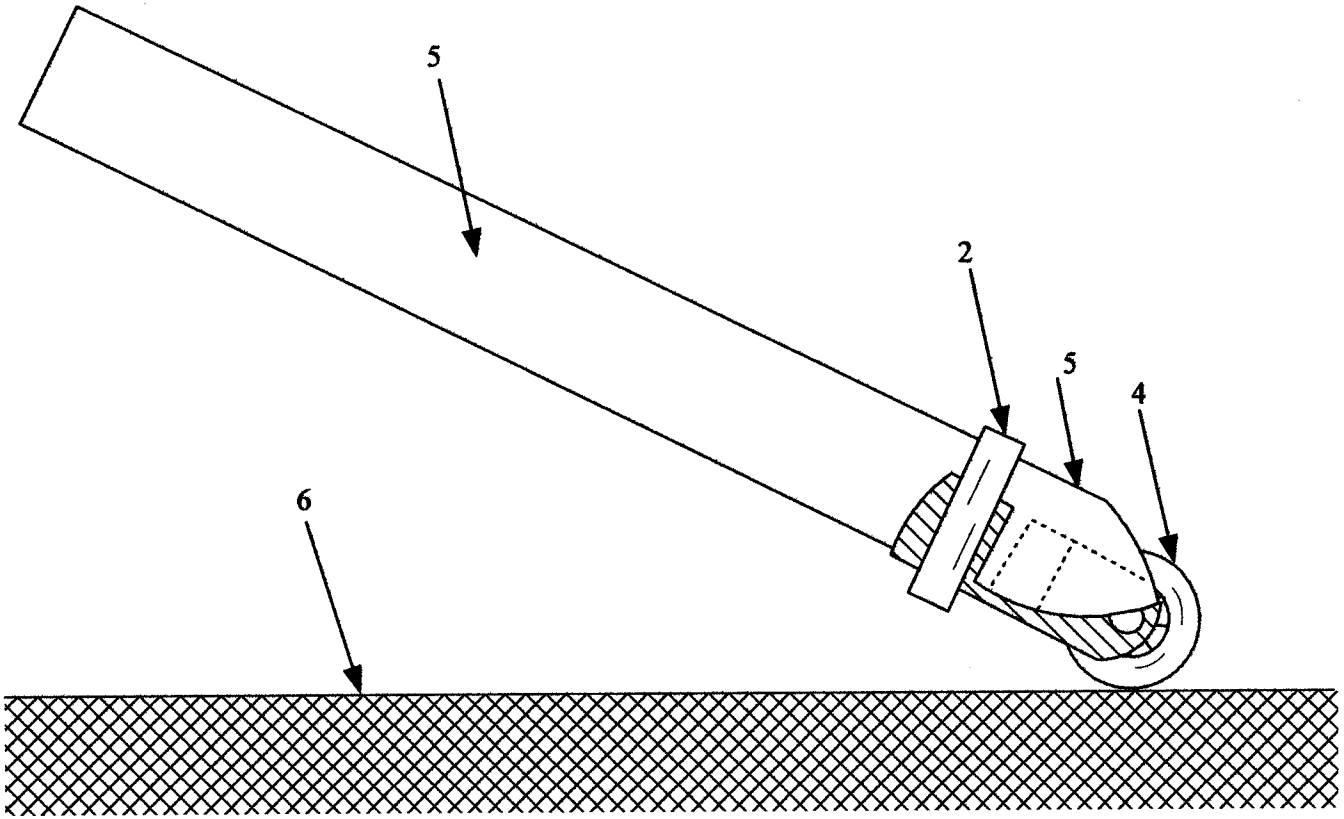
FIG. 7 is side elevation of view showing the device of FIG. 3 with rear end of the skis lifted above the surface across which the skis are being transported.

The second embodiment of the invention (illustrated in FIGS. 5, 6 and 7) is identical to the first embodiment of the invention except in the second embodiment of the invention the "U" shaped channel 7 of carriage body 1 is adapted to receive the side edges of a pair of skis 5 disposed in bottom-to-bottom relationship which are proximate the front, curved end of said pair of skis (as illustrated in FIGS. 6 and 7). Accordingly in said second embodiment the width of "U" shaped channel 7 is wider towards the rear of carriage body 1 (as shown in FIGS. 5 and 6), may extend through sides 12 and 13 (as shown in FIGS. 5, 6 and 7) and rear 14 may be configured as a forward projecting wedge shape (as is shown in FIGS. 5 and 6)

Carriage body 1 may be fabricated of any durable material, including but not limited to metals, wood and composite (commonly referred to as "plastic") materials, sufficiently strong and rigid to bear weight of pair of skis (if desired, along with bindings, boots and poles). However in preferred embodiment it is desired that a material that is light, non-brittle, impact resistant and is at least somewhat pliable (so that bodily injury is avoided or at least minimized in the event of a skier falling on carriage body 1). Preferred is a medium-high density polypropylene or nylon composite. In order to further mitigate against the possibility of bodily injury to a skier in the event of a fall onto carriage body 1 it is also desirable that sharp or pointed edges and corners be avoided, rather a carriage body 1 designed with smooth edges and rounded corners, such as shown in the figures is preferred. Carriage body 1 may be made of a brightly colored composite, or alternatively painted or dyed a bright color so as to facilitate locating the ski tote of the invention if lost in snow. To increase the aesthetic characteristics of the invention carriage body 1 may be a variety of colors, designs and/or shapes.

The next principal component of the invention is the binding means 2. While skis 5 might be "pushed" with the invention, it is preferred they be "pulled" by application of and upward and forward force applied near the front of the skis 5, with the invention herein disclosed installed at the bottom-rear ("trailing edge") of the skis 5. "Pulled" in this fashion skis 5 would tend to be pulled forward out of the front 15 of "U" shaped channel 7 if carriage body 1 and/or lifted out the top 16 of the "U" shaped channel 7 of carriage body 1 unless retained in said "U" shaped channel 7 of carriage body 1 by appropriate means. In preferred embodiment skis 5 are retained in the "U" shaped channel 7 of carriage body 1 by means of flexible strap 2, preferably made of strong, durable, resistant to decomposition by moisture and light man-made fibers which having mating hook and loop (sometimes referred to as "Velcro®") fasteners. In the preferred embodiment strap 2 actually has a dual purpose. Not only does it provide means to reversibly bind a pair of skis 5 to carriage body 1 for rolling transportation of the skis across the surface of storage, staging and like areas but also provides a facile means for the skier to attach the invention herein disclosed to a ring, hook or strap of a clothing of the skier (thus easily transport the invention with the skier) when the skis are being used for skiing. Alternatively the small size of the invention will allow it to be carried in the pocket of the skier's clothing when the skier is actually skiing. This is particularly useful when skiing does not start and end at the same locations, but at both locations it would be necessary to transport the skis (and other skiing equipment) some distance before being installed upon and after removal from the skier's feet). If the invention herein disclosed can carried with the skier (in a pocket of the skier's clothing or alternatively hung from the skier's clothing) while skiing (thereby used at beginning and end locations). Those skilled in the art will realize that other flexible and non-flexible binding and fastening means, including but not limited to straps, tape, ropes, wires, pins and clips, along with buttons, snaps, other form of hook and loop fasteners and the like which would serve the function of reversibly binding pair of skis 5 the carriage body 1 might be used thus are intended to fall within the scope of the invention herein claimed.

The third major component of the invention is wheel mounting means 3. In preference wheel mounting means 3 extends to the rear of carriage body 1 and provides a means supporting horizontally disposed axle 31 (upon which wheel 4 may be vertically disposed). To facilitate construction of the invention herein disclosed In preferred embodiment wheel mounting means 3 will be integrally formed with carriage body 1. Alternatively wheel mounting means 3 may be rigidly attached to carriage body 1, or could be mounted to spring(s) or spring(s) and shock absorbing means which are in turn mounted to carriage body 1.

Alternatively, wheel mounting means 3 might extend below carriage body 1, have multiple wheels or set of wheels disposed outboard of wheel mounting means 3. In whatever configuration it is essential that when a pair of skis 5 is disposed in bottom-to-bottom relationship to each other (as shown in FIGS. 4 and 7), the side edges of one end of said pair of skis 5 bound in channel 7 of carriage body 1 and the opposite end of said skis 5 lifted (as shown in FIGS. 4 and 7) above surface only wheel(s) 4 remain in contact with surface 6, thus said skis 5 may be transported by rolling wheel 4 across said surface 6.

The last major component of the invention herein disclosed is wheel 4. While in the preferred embodiment of the invention wheel 4 is a single wheel, made of durable polyurethane (such as typically used on skate-boards and the like), those skilled in the art will recognize numerous equivalents, all of which are intended to be comprehended by the scope of the invention herein disclosed, including but not necessarily limited to metal wheels, wooden wheels, wheels of made of various composite materials, narrower and wider wheels, wheels having smaller and larger diameters, a plurality of wheels and wheels which may be disposed outboard (rather than inboard as shown in the figures) of wheel mounting means 3.

The invention is simple and easy to use. In preference a pair of skis 5 is disposed in bottom-to-bottom relationship to each other (as shown in FIG. 4) and either the rear or front corner of said pair of skis 5 inserted into "U" shaped channel 7 of carriage body 1. Binding means 2 is then utilized to fasten the skis 5 and carriage body 1 together (as is shown in FIGS. 3, 4, 6 and 7). Ski boots and poles may be temporarily attached to pair of skis 5 (preferably top thereof), either before or after placement of a corner of pair of skis 5 in "U" shaped channel 7 of carriage body 1. After installation of the invention onto one end of a pair of skis 5 the opposite end of said pair of skis is lifted above surface 6 until only wheel 4 is engaged with surface 6, thereby allowing the pair of skis 5 (an other equipment if attached thereto) to be rolled along surface 6, which the user may typically do with one hand, without having to bear the weight upon one or both of his/her shoulders s, as is typically done. When skiing the skier may carry the invention herein disclosed either attached to a ring, hook or loop of the ski dress, carried in the pocket of ski dress or left in even a small size locker.

While the above description contains certain specifics, these should not be construed as limitations on the scope of the invention, but rather as an exemplification of one preferred embodiment thereof. Accordingly, the scope of the present invention should be determined not by the embodiment(s) illustrated, but by such claims and their legal equivalents as may be granted upon the disclosure herein made.

The invention claimed is:

1. A miniature ski tote, for transportation of a pair of skis, each ski having a top, a bottom, first and second sides having edges, a curved front end and generally flat rear end, assembled with abutting bottoms, aligned sides and rear ends, comprising:

a. a carriage body having a top, bottom, first side, second side, front and rear, wherein said bottom, sides and rear together form a channel having a depth, width and length, wherein said width and depth of said channel opens to the front, the first and second sides of said carriage body, said length and width of said channel opens to the top of said carriage body and is configured to receive a portion of the side edges of said curved front end of said pair of skis with the front tip of one ski projecting through the first side of said carriage body and the front tip of the other ski projecting through the second side of said carriage body;

b. a wheel, having an axis of rotation parallel to the width of said carriage body, rotatably attached to and projecting to the rear of the carriage body; and, c. means to reversibly bind said skis in said channel of said carriage body.

2. The miniature ski tote of claim 1 wherein said channel bifurcates into a first and a second sub-channel as the length of said channel extends towards the rear of said carriage body.

3. The miniature ski tote of claim 2 wherein said first sub-channel extends through first side of said carriage body and said second sub-channel extends through the second side of said carriage body, thereby allowing for a tip of front of one ski to project through the first side of said carriage body and the tip of the other ski to project through second side of said carriage body.

4. The miniature ski tote of claim 3 wherein the rear of said carriage body is generally configured as an isosceles triangle having a apex which projects towards the front of said carriage body.

5. The miniature ski tote of claim 4 wherein a portion of said wheel also projects below the bottom of said carriage body when said bottom of said carriage body is level.

6. The miniature ski tote of claim 5 wherein said means for releasably binding said pair of skis to said carriage body comprises a flexible strap attached to said carriage body.

7. The miniature ski tote of claim 6 wherein said flexible strap comprises a plurality of mating hook and loop fasteners.

8. The miniature ski tote of claim 2 wherein the rear of said carriage body is generally configured as an isosceles triangle having a apex which projects towards the front of said carriage body.

9. The miniature ski tote of claim 8 wherein a portion of said wheel also projects below the bottom of said carriage body when said bottom of said carriage body is level.

10. The miniature ski tote of claim 9 wherein said means for releasably binding said pair of skis to said carriage body comprises a flexible strap attached to said carriage body.

* * * * *